US009378674B2

(12) United States Patent
Kim

(10) Patent No.: US 9,378,674 B2
(45) Date of Patent: Jun. 28, 2016

(54) ORGANIC LIGHT EMITTING DIODE (OLED) DISPLAY AND METHOD OF DRIVING THE SAME

(71) Applicant: Samsung Display Co., Ltd., Yongin, Gyeonggi-do (KR)

(72) Inventor: Hyung-Soo Kim, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 55 days.

(21) Appl. No.: 14/010,401

(22) Filed: Aug. 26, 2013

(65) Prior Publication Data

US 2014/0210696 A1 Jul. 31, 2014

(30) Foreign Application Priority Data

Jan. 30, 2013 (KR) ..... 10-2013-0010521

(51) Int. Cl.
*G09G 3/32* (2006.01)

(52) U.S. Cl.
CPC ..... *G09G 3/3233* (2013.01); *G09G 3/3208* (2013.01); *G09G 2300/0861* (2013.01)

(58) Field of Classification Search
CPC ..... G09G 3/325; G09G 3/3208
USPC ..... 345/92, 82
See application file for complete search history.

(56) References Cited

U.S. PATENT DOCUMENTS

| | | | | |
|---|---|---|---|---|
| 2005/0116656 | A1* | 6/2005 | Shin | 315/169.3 |
| 2007/0200814 | A1* | 8/2007 | Kwon | 345/92 |
| 2009/0135107 | A1* | 5/2009 | Kim | 345/76 |
| 2010/0013868 | A1 | 1/2010 | Chung | |
| 2011/0316892 | A1* | 12/2011 | Sung et al. | 345/690 |

FOREIGN PATENT DOCUMENTS

| | | | |
|---|---|---|---|
| KR | 10-2005-0085309 | A | 8/2005 |
| KR | 10-0732853 | B1 | 6/2007 |
| KR | 10-2008-0002398 | A | 1/2008 |
| KR | 10-2010-0008909 | A | 1/2010 |

* cited by examiner

*Primary Examiner* — Amare Mengistu
*Assistant Examiner* — Joseph G Rodriguez
(74) *Attorney, Agent, or Firm* — Knobbe, Martens, Olson & Bear, LLP

(57) ABSTRACT

An organic light emitting diode (OLED) display is disclosed. In one aspect, the OLED display includes a scan driver for supplying first scan signals to first scan lines and supplying second scan signals to second scan lines and a data driver for supplying voltage data signals to first data lines in synchronization with the second scan signals. The OLED display also includes a current sink unit for supplying current data signals to second data lines in synchronization with the first scan signals, and pixels coupled to the first scan lines, the second scan lines, the first data lines, and the second data lines, having amounts of currents controlled to correspond to the current data signals, and having emission times controlled to correspond to the voltage data signals.

13 Claims, 3 Drawing Sheets

ORGANIC LIGHT EMITTING DIODE (OLED) DISPLAY AND METHOD OF DRIVING THE SAME

CROSS-REFERENCE TO RELATED APPLICATION

This application claims priority to and the benefit of Korean Patent Application No. 10-2013-0010521, filed on Jan. 30, 2013, in the Korean Intellectual Property Office, the entire content of which is incorporated herein by reference.

BACKGROUND

1. Field

The described technology generally relates to an organic light emitting diode (OLED) display and a method of driving the same.

2. Description of the Related Technology

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting diode (OLED) displays.

Among the FPDs, the OLED displays display images using organic light emitting diodes (OLED) that generate light by re-combination of electrons and holes. The OLED display has high response speed and is driven with low power consumption.

SUMMARY

One inventive aspect is an OLED display capable of displaying an image with desired brightness and a method of driving the same.

Another aspect is an OLED display, including a scan driver for supplying first scan signals to first scan lines and supplying second scan signals to second scan lines, a data driver for supplying voltage data signals to first data lines in synchronization with the second scan signals, a current sink unit for supplying current data signals to second data lines in synchronization with the first scan signals, and pixels coupled to the first scan lines, the second scan lines, the first data lines, and the second data lines, having amounts of currents controlled to correspond to the current data signals, and having emission times controlled to correspond to the voltage data signals.

The current data signal is supplied to have one of at least two current levels to correspond to data supplied from the outside. The current sink unit sinks a current from a pixel to correspond to the current level of the current data signal. The current level of the current data signal is set so that a voltage corresponding to the current data signal is stably charged in a pixel in a supply period of the first scan signal. The scan driver supplies at least two of the second scan signals to an ith second scan line after a first scan signal is supplied to an ith (i is a natural number) first scan line. The voltage data signal is set as one of a first data signal corresponding to emission of pixels and a second data signal corresponding to non-emission of the pixels.

Each of the pixels includes an organic light emitting diode (OLED), a first transistor for controlling an amount of current supplied to the OLED coupled to a second node to correspond to a voltage applied to a first node, a second transistor coupled between the second node and a second data line and turned on when the first scan signal is supplied, a third transistor coupled between the first node and the second node and turned on when the first scan signal is supplied, a fifth transistor coupled between the second node and the OLED, a fourth transistor coupled between a gate electrode of the fifth transistor and the first data line and turned on when the second scan signal is supplied, and a first capacitor coupled between the first node and a first power supply. Each of the pixels further includes a second capacitor coupled between the gate electrode of the fifth transistor and the first power supply.

Another aspect is a method of driving an OLED display, including sinking a current corresponding to a current data signal by each of pixels selected by first scan signals and charging predetermined voltages in the pixels and supplying voltage data signals corresponding to at least two of the second scan signals at predetermined intervals after the first scan signals and controlling emission and non-emission of the pixels. A current level of the current data signal is selected from at least two different current levels to correspond to a gray scale of data.

The current level of the current data signal is set so that a voltage corresponding to the current data signal may be stably charged in a pixel in a supply period of the first scan signal. The voltage data signal is set as one of a first data signal by which the pixels emit light and a second data signal by which the pixels do not emit light.

DETAILED DESCRIPTION

Figure 1:
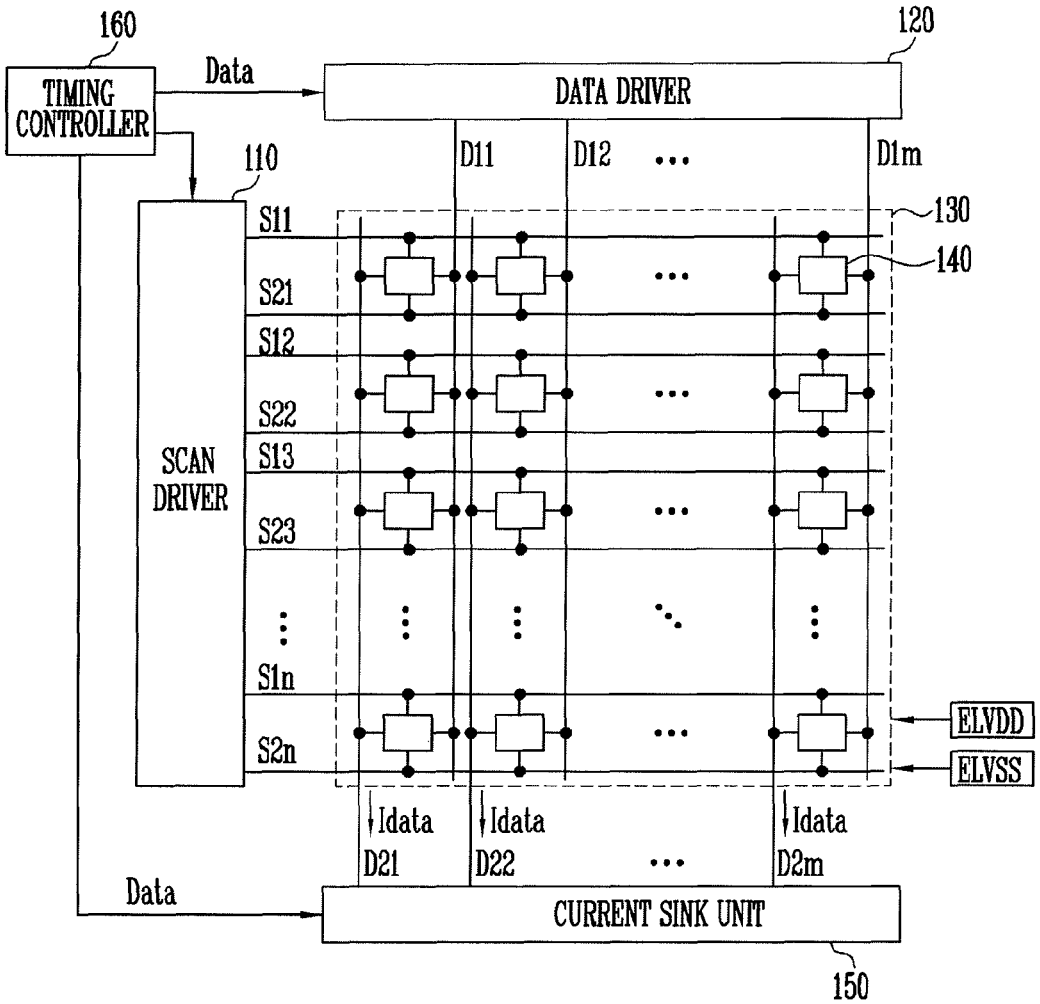
FIG. 1 is a view illustrating an OLED display according to an embodiment.

Generally, an OLED display includes a plurality of pixels arranged at intersections of a plurality of data lines, scan lines, and power supply lines in a matrix. Each of the pixels stores a voltage corresponding to a data signal and supplies current corresponding to the stored voltage to an OLED using a driving transistor to generate light with predetermined brightness.

On the other hand, the threshold voltages and mobilities of the driving transistors included in the pixels become non-uniform due to a process deviation so that desired brightness is not displayed.

In order to solve the above problem, a method of supplying current as a data signal is suggested. When the current is supplied as the data signal, brightness may be realized regardless of a deviation in the threshold voltages and mobilities of the driving transistors. However, when the current is supplied as the data signal, it is difficult to display low gray scales. That is, when microcurrent is supplied in order to realize the low gray scales, a desired voltage is not charged in a pixel within a determined time (for example, 1 horizontal period (1H)) so that an image with desired gray scales may not be realized.

Hereinafter, certain exemplary embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, an OLED display and a method of driving the same will be described in detail as follows with reference to FIGS. 1 to 4.

FIG. 1 is a view illustrating an OLED display according to an embodiment.

Referring to FIG. 1, the OLED display includes a pixel unit 130 including pixels 140 positioned at intersections of first scan lines S11 to S1n and first data lines D11 to D1m, a scan driver 110 for driving the first scan lines S11 to Sln and second scan lines S21 to S2n and a data driver 120 for driving the first data lines D11 to D1m. The OLED display also includes a current sink unit 150 for driving second data lines D21 to D2m, and a timing controller 160 for controlling the scan driver 110, the data driver 120, and the current sink unit 150.

Figure 3:
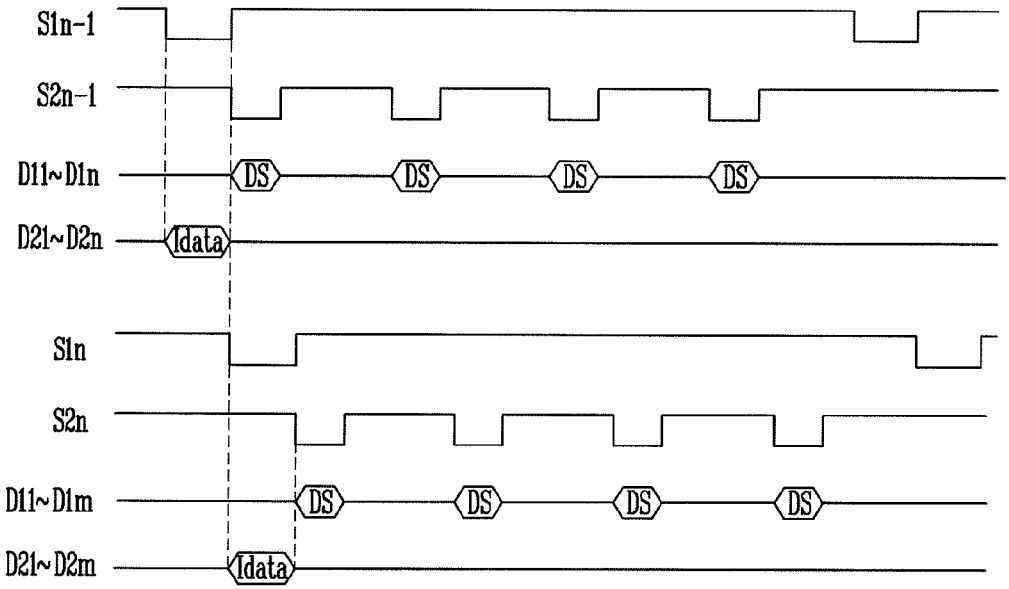
FIG. 3 is a waveform diagram illustrating an embodiment of driving waveforms supplied to the pixel illustrated in FIG. 2.

The scan driver 110 sequentially supplies first scan signals to the first scan lines S11 to Sin as illustrated in FIG. 3. When the first scan signals are sequentially supplied to the first scan lines S11 to S1n, the pixels 140 are sequentially selected in units of horizontal lines.

The scan driver 110 supplies second scan signals to the second scan lines S21 to S2n. In one embodiment, the scan driver 110 supplies at least two of the second scan signals to each of the second scan lines S21 to S2n in one frame period.

In some embodiments, the scan driver 110 supplies a first scan signal to an ith (i is a natural number) first scan line S1i in a specific frame period. After the first scan signal is supplied to the ith first scan line S1i, the scan driver 110 may supply at least two second scan signals to an ith second scan line S2i at predetermined intervals.

The current sink unit 150 supplies current data signals Idata to the second data lines D21 to D2m in synchronization with the first scan signals. Here, the current data signal Idata means that a predetermined current is sunken by a pixel 140 selected by the first scan signal. For this purpose, a current source (not shown) that may sink at least two current levels is included in each of the channels of the current sink unit 150 and the current sink unit 150 performs control so that current corresponding to a predetermined current level may be sunken to correspond data Data supplied by the timing controller 160. In some embodiments, the current data signal Idata has a plurality of current levels and one current level is selected to correspond to the data.

The current level of the current data signal Idata may be experimentally determined so that a desired voltage may be charged in the pixel 140 in a supply period of the first scan signal. For example, the current level of the current data signal Idata may be selected from four current levels and the four current levels are set so that the desired voltage may be charged in the pixel 140 in the supply period of the first scan signal.

The data driver 120 supplies voltage data signals to the first data lines D11 to D1m in synchronization with the second scan signals. For example, the data driver 120 supplies first data signals corresponding to emission of the pixels 140 or second data signals corresponding to non-emission of the pixels 140 in synchronization with the second scan signals.

The pixel unit 130 receives a first power supply ELVDD and a second power supply ELVSS from the outside. The first power supply ELVDD and the second power supply ELVSS supplied to the pixel unit 130 are supplied to each of the pixels 140.

The pixels 140 charges voltages corresponding to the current data signals Idata from the current sink unit 150 when the first scan signals are supplied. Here, the voltages are charged in the pixels 140 by currents sunken by the current sink unit 150 to correspond to the current data signals Idata so that desired voltages may be charged regardless of threshold voltages and mobilities of driving transistors of the pixels 140.

The pixels 140 that charge the voltages corresponding to the current data signals Idata receive the voltage data signals when the second scan signals are supplied. The pixels 140 that receive the first data signals may be set to be in an emission state in a predetermined period and the pixels 140 that receive the second data signals may be set to be in a non-emission state in a predetermined period. In some embodiments, since at least two of the second scan signals are supplied in one frame period, the pixels 140 are selected to be in the emission or non-emission state at least two times in one frame period to realize gray scales.

Figure 2:
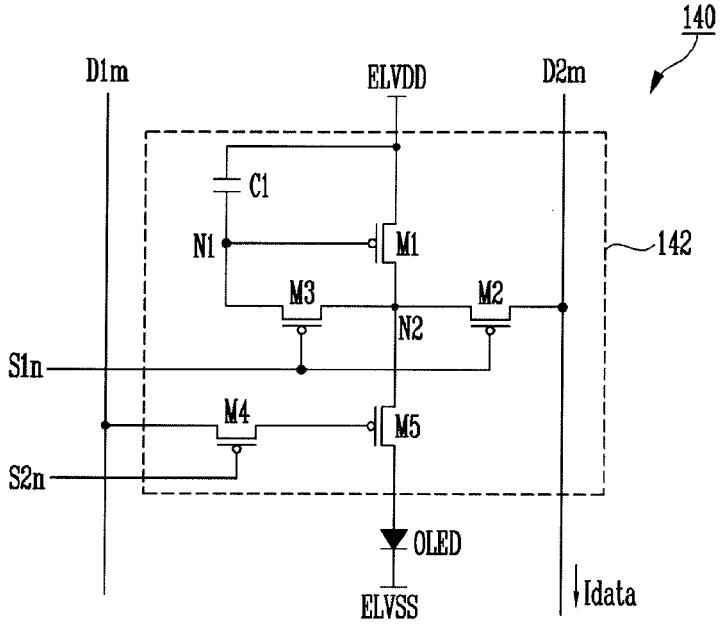
FIG. 2 is a view illustrating a pixel according to a first embodiment.

FIG. 2 is a view illustrating a pixel according to a first embodiment. In FIG. 2, for convenience sake, the pixel coupled to an nth horizontal line and an mth vertical line will be illustrated.

Referring to FIG. 2, a pixel 140 includes an organic light emitting diode (OLED) and a pixel circuit 142 for controlling the amount of current supplied to the OLED.

The OLED generates light with predetermined brightness to correspond to the amount of current supplied by the pixel circuit 142.

The pixel circuit 142 charges a predetermined voltage to correspond to the current data signal Idata and supplies a current corresponding to the charged voltage to the OLED. In some embodiments, the pixel circuit 142 controls current supply time of the OLED to correspond to a voltage data signal. The pixel circuit 142 may include first to fifth transistors M1 to M5 and a first capacitor C1.

A first electrode of the first transistor M1 is coupled to a first power supply ELVDD and a second electrode of the first transistor M1 is coupled to a second node N2. A gate electrode of the first transistor M1 is coupled to a first node N1. The first transistor M1 controls an amount of current supplied to the OLED to correspond to a voltage applied to the first node N1.

A first electrode of the second transistor M2 is coupled to the second node N2 and a second electrode of the second transistor M2 is coupled to the second data line D2m. A gate electrode of the second transistor M2 is coupled to the first scan line S1n. The second transistor M2 is turned on when the first scan signal is supplied to the first scan line S1n to electrically couple the second data line D2m and the second node N2 to each other.

A second electrode of the third transistor M3 is coupled to the second node N2 and a first electrode of the third transistor M3 is coupled to the first node N1. A gate electrode of the third transistor M3 is coupled to the first scan line S1n. The third transistor M3 is turned on when the first scan signal is supplied to the first scan line S1n to electrically couple the first node N1 and the second node N2 to each other.

A first electrode of the fourth transistor M4 is coupled to the first data line D1m and a second electrode of the fourth transistor M4 is coupled to a gate electrode of the fifth transistor M5. A gate electrode of the fourth transistor M4 is coupled to the second scan line S2n. The fourth transistor M4 is turned on when the second scan signal is supplied to the second scan line S2n to electrically couple the first data line D1m and the gate electrode of the fifth transistor M5 to each other.

A first electrode of the fifth transistor M5 is coupled to the second node N2 and a second electrode of the fifth transistor M5 is coupled to an anode electrode of the OLED. The gate electrode of the fifth transistor M5 is coupled to the second electrode of the fourth transistor M4. The fifth transistor M5 is turned on or off to correspond to the voltage data signal supplied when the fourth transistor M4 is turned on.

The first capacitor C1 is coupled between the first node N1 and the first power supply. The first capacitor C1 charges the voltage corresponding to the current data signal.

FIG. 3 is a waveform diagram illustrating an embodiment of driving waveforms supplied to the pixel illustrated in FIG. 2.

When operating processes are described with reference to FIGS. 2 and 3, first, the first scan signal is supplied to the first scan line S1n so that the second and third transistors M2 and M3 are turned on. When the transistors M2 and M3 are turned on, the first and second nodes N1 and N2, and the second data line D2m are electrically coupled to each other.

At this time, the current sink unit 150 supplies the current data signal Idata corresponding to the data Data to the second data line D2m. That is, the current sink unit 150 sinks a predetermined current to correspond to the data Data. The predetermined current sunken by the current sink unit 150 flows via the first power supply ELVDD, the first transistor M1, and the second transistor M2. At this time, a voltage corresponding to the predetermined current is applied to the first node N1 and the applied voltage is charged in the first capacitor C1.

On the other hand, the voltage charged in the first capacitor C1 is determined by the predetermined current. In this case, a desired voltage is charged in the first capacitor C1 regardless of a threshold voltage and mobility of the first transistor M1. In addition, the current level of the current data signal Idata is determined so that a voltage corresponding to the current level may be charged in the first node N1 in the supply period of the first scan signal. Therefore, the desired voltage may be stably charged in the first capacitor C1.

After the voltage is charged in the first capacitor C1, the second scan signal is supplied to the second scan line S2n so that the fourth transistor M4 is turned on. When the fourth transistor M4 is turned on, the voltage data signal supplied by the data driver 120 in synchronization with the second scan signal is supplied to the gate electrode of the fifth transistor M5. Here, the voltage data signal is set as the first data signal by which the fifth transistor M5 is turned on or the second data signal by which the fifth transistor M5 is turned off.

When the first data signal is supplied as the voltage data signal, the fifth transistor M5 is turned on. Then, the current supplied by the first transistor M1 to correspond to the voltage charged in the first capacitor C1 is supplied to the OLED so that light with predetermined brightness is generated. On the other hand, when the second data signal is supplied as the voltage data signal, the fifth transistor M5 is turned off. In one embodiment, when the fifth transistor M5 is turned off, regardless of the voltage charged in the first capacitor C1, the pixel 140 is set in a non-emission state.

In some embodiments, the second scan signal and the voltage data signal in synchronization with the second scan signal are supplied at least twice at predetermined intervals in one frame period. Then, the emission time of the pixel 140 is controlled to correspond to the voltage data signal so that a predetermined gray scale may be realized.

In some embodiments, gray scales are realized using the current levels (at least two current levels) of the current data signal Idata and emission times corresponding to the voltage data signals. When the gray scales are realized using the current levels and the emission times, the gray scales may be realized by various methods. For example, 256 gray scales may be realized using four current levels and four voltage data signals. When the gray scales are realized using the current levels and the emission times, the current levels of the current data signal Idata may be set to be high so that the desired voltage may be charged in the pixel 140 in the supply period of the first scan signal.

Figure 4:
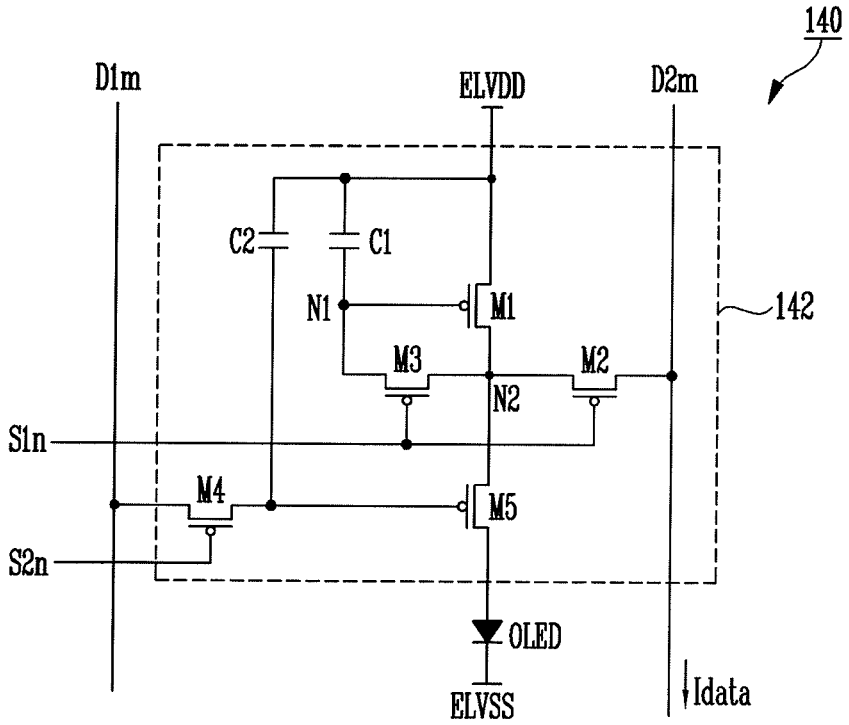
FIG. 4 is a view illustrating a pixel according to a second embodiment.

FIG. 4 is a view illustrating a pixel according to a second embodiment. In describing FIG. 4, the same elements as those of FIG. 2 are denoted by the same reference numerals and detailed description thereof will be omitted.

Referring to FIG. 4, the pixel 140 according to the second embodiment further includes a second capacitor C2 coupled between the gate electrode of the fifth transistor M5 and the first power supply ELVDD. The second capacitor C2 stores a predetermined voltage to correspond to the voltage data signal.

When the second capacitor C2 is omitted like in the first embodiment, the voltage data signal is stored in a parasitic capacitor that is not shown. In this case, the voltage data signal may not be stably charged so that reliability of the pixel 140 may deteriorate. In the second embodiment, the second capacitor C2 is added so that stability of driving is secured. Since the other operating processes are the same as those of the first embodiment of the present invention, detailed description thereof will be omitted.

In some embodiments, the transistors are illustrated as PMOS transistors. However, the present invention is not limited to the above. That is, the transistors may be NMOS transistors.

In addition, according to some embodiments, the OLED generates red, green, or blue light to correspond to the amount of current supplied by the driving transistor. However, the present invention is not limited to the above. For example, the OLED may generate white light to correspond to the amount of current supplied by the driving transistor. In this case, a color image is realized using an additional color filter.

According to at least one of the disclosed embodiments, the current levels sunken by the pixels and the emission times of the pixels are controlled so that gray scales are realized. Here, when the gray scales are realized using the current levels and the emission times, display of the gray scales may be improved. Therefore, the current levels may be set so that the voltages may be stably charged in the pixels. Accordingly, a voltage is charged in a pixel using at least two current levels at which the voltage may be stably charged in the pixel and emission time of the pixel in which the voltage is charged is controlled so that predetermined gray scales are realized. Furthermore, an image with desired brightness may be displayed regardless of a threshold voltage and mobility of a driving transistor.

While the above embodiments have been described in connection with the accompanying drawings, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting diode (OLED) display, comprising:

a scan driver configured to respectively supply a plurality of first scan signals to a plurality of first scan lines and respectively supply a plurality of second scan signals to a plurality of second scan lines;

a data driver configured to respectively supply a plurality of voltage data signals to a plurality of first data lines in synchronization with the second scan signals;

a current sink unit configured to respectively supply a plurality of current data signals to a plurality of second data lines in synchronization with the first scan signals; and a plurality of pixels coupled to the first and second scan lines, and the first and second data lines, wherein amounts of currents in the pixels are configured to be controlled to correspond to the current data signals, wherein emission times in the pixels are configured to be controlled to correspond to the voltage data signals, and wherein the data driver is further configured to supply the voltage data signals, corresponding to at least two of the second scan signals in one frame period, at a substantially constant interval such that adjacent voltage data signals are spaced apart from each other during the frame period.

2. The OLED display as claimed in claim 1, wherein the current data signal is configured to be supplied to have one of at least two current levels to correspond to data supplied from an external data source.

3. The OLED display as claimed in claim 2, wherein the current sink unit is configured to sink a current from a pixel to correspond to the current level of the current data signal.

4. The OLED display as claimed in claim 2, wherein the current level of the current data signal is configured to be set such that a voltage corresponding to the current data signal is stably charged in a pixel in a supply period of the first scan signal.

5. The OLED display as claimed in claim 1, wherein the scan driver is configured to supply at least two of the second scan signals to an ith second scan line after a first scan signal is supplied to an ith (i is a natural number) first scan line.

6. The OLED display as claimed in claim 1, wherein the voltage data signal is configured to be set as one of a first data signal corresponding to emission of the pixels and a second data signal corresponding to non-emission of the pixels.

7. The OLED display as claimed in claim 1, wherein each of the pixels comprises:

an OLED:

a first transistor configured to control an amount of current supplied to the OLED to correspond to a voltage applied to a first node, wherein the OLED is coupled to a second node;

a second transistor coupled between the second node and a second data line and configured to be turned on when the first scan signal is supplied;

a third transistor coupled between the first node and the second node and configured to be turned on when the first scan signal is supplied;

a fourth transistor configured to be turned on when the second scan signal is supplied;

a fifth transistor coupled between the second node and the OLED, wherein the fourth transistor is coupled between a gate electrode of the fifth transistor and the first data line; and a first capacitor coupled between the first node and a first power supply.

8. The OLED display as claimed in claim 7, wherein each of the pixels further comprises a second capacitor coupled between the gate electrode of the fifth transistor and the first power supply.

9. The OLED display as claimed in claim 1, wherein the data driver is further configured to supply the voltage data signals, corresponding to at least three of the second scan signals, at a substantially constant interval.

10. The OLED display as claimed in claim 1, wherein each of the voltage data signals is supplied during a predetermined time in the frame period, and wherein the substantially constant interval is greater than the predetermined time.

11. A method of driving an organic light emitting diode (OLED) display, comprising:

sinking a current corresponding to a current data signal by each of a plurality of pixels selected by a plurality of first scan signals and charging predetermined voltages in the pixels; and supplying a plurality of voltage data signals, corresponding to at least two of a plurality of second scan signals, in one frame period at a substantially constant interval such that adjacent voltage data signals are spaced apart from each other during the frame period after the first scan signals and controlling emission and non-emission of the pixels, and wherein a current level of the current data signal is selected from at least two different current levels to correspond to a gray scale of data.

12. The method as claimed in claim 11, wherein the current level of the current data signal is set such that a voltage corresponding to the current data signal is stably charged in a pixel in a supply period of the first scan signal.

13. The method as claimed in claim 11, wherein the voltage data signal is set as one of a first data signal by which the pixels emit light and a second data signal by which the pixels do not emit light.

* * * * *